US007730966B2

(12) United States Patent
Fragachan

(10) Patent No.: US 7,730,966 B2
(45) Date of Patent: Jun. 8, 2010

(54) HIGH DENSITY SLURRY

(75) Inventor: Francisco Fragachan, Barcelona (ES)

(73) Assignee: M-I L.L.C., Houston, TX (US)

( * ) Notice: Subject to any disclaimer, the term of this patent is extended or adjusted under 35 U.S.C. 154(b) by 152 days.

(21) Appl. No.: 12/021,732

(22) Filed: Jan. 29, 2008

(65) Prior Publication Data

US 2008/0179092 A1 Jul. 31, 2008

Related U.S. Application Data

(60) Provisional application No. 60/887,454, filed on Jan. 31, 2007.

(51) Int. Cl.
*E21B 21/06* (2006.01)

(52) U.S. Cl. ..... 175/24; 175/66; 175/206

(58) Field of Classification Search ..... 175/24, 175/66, 206

See application file for complete search history.

(56) References Cited

U.S. PATENT DOCUMENTS

| | | | | |
|---|---|---|---|---|
| 3,964,557 | A * | 6/1976 | Juvkam-Wold | 175/66 |
| 5,303,786 | A | 4/1994 | Prestridge et al. | |
| 6,213,227 | B1 | 4/2001 | Dietzen | |
| 6,345,672 | B1 * | 2/2002 | Dietzen | 175/66 |
| 6,698,989 | B2 | 3/2004 | Snowdon et al. | |
| 6,702,539 | B2 | 3/2004 | Snowdon et al. | |
| 6,709,216 | B2 | 3/2004 | Snowdon et al. | |
| 6,745,856 | B2 | 6/2004 | Simpson et al. | |
| 2002/0033278 | A1 * | 3/2002 | Reddoch | 175/57 |
| 2007/0131454 | A1 * | 6/2007 | Hollier et al. | 175/66 |
| 2008/0179090 | A1 * | 7/2008 | Eia et al. | 175/5 |
| 2008/0179095 | A1 * | 7/2008 | Eia | 175/66 |
| 2008/0179096 | A1 * | 7/2008 | Eia et al. | 175/66 |
| 2008/0179097 | A1 * | 7/2008 | Eia et al. | 175/66 |
| 2008/0210467 | A1 * | 9/2008 | Eia | 175/24 |

FOREIGN PATENT DOCUMENTS

WO 9904134 1/1999

OTHER PUBLICATIONS

PCT International Search Report issued in PCT Application No. PCT/US2008/052585 dated Jul. 29, 2008 (4 pages).

PCT Written Opinion issued in PCT Application No. PCT/US2008/052585 dated Jul. 29, 2008 (4 pages).

* cited by examiner

*Primary Examiner*—William P Neuder
(74) *Attorney, Agent, or Firm*—Osha • Liang LLP

(57) ABSTRACT

A module for slurrifying drill cuttings that includes a skid, a programmable logic controller disposed on the skid, and a blender. The blender including a feeder for injecting drill cuttings, a gate disposed in fluid communication with the feeder for controlling a flow of the drill cuttings, and an impeller for energizing a fluid, wherein the module is configured to be removably connected to a cuttings storage vessel located at a work site. Also, a method of drill cuttings re-injection that includes creating a slurry including greater than 20 percent by volume drill cuttings in a blender system, and pumping the slurry from the blending system to a cuttings injection system. The method further includes injecting the slurry from the cuttings injection system into a wellbore.

20 Claims, 4 Drawing Sheets

HIGH DENSITY SLURRY

CROSS-REFERENCE TO RELATED APPLICATION

This application, pursuant to 35 U.S.C. §119(e), claims priority to U.S. Provisional Application Ser. No. 60/887,454, filed Jan. 31, 2007. That application is incorporated by reference in its entirety.

BACKGROUND

1. Field of the Disclosure

Embodiments disclosed herein relate generally to systems and methods for producing slurries for re-injection at a work site. More specifically, embodiments disclosed herein relate to systems and methods for producing high-density slurries for re-injection at a work site. More specifically still, embodiments disclosed herein relate to systems and methods for producing high-density slurries for re-injection at a work site using a module to convert cutting storage and transfer vessels at the work site.

2. Background

In the drilling of wells, a drill bit is used to dig many thousands of feet into the earth's crust. Oil rigs typically employ a derrick that extends above the well drilling platform. The derrick supports joint after joint of drill pipe connected end-to-end during the drilling operation. As the drill bit is pushed further into the earth, additional pipe joints are added to the ever lengthening "string" or "drill string". Therefore, the drill string includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In the Gulf of Mexico, for example, there are hundreds of drilling platforms that drill for oil and gas by drilling into the subsea floor. These drilling platforms may be used in places where the depth of the water is many hundreds of feet. In such a marine environment, the water is typically filled with marine life that cannot tolerate the disposal of drill cuttings waste. Therefore, there is a need for a simple, yet workable solution to the problem of disposing of well cuttings, drilling mud, and/or other waste in marine and other fragile environments.

Traditional methods of disposal include dumping, bucket transport, cumbersome conveyor belts, screw conveyors, and washing techniques that require large amounts of water. Adding water creates additional problems of added volume and bulk, pollution, and transport problems. Installing conveyors requires major modification to the rig area and involves extensive installation hours and expense.

Another method of disposal includes returning the drill cuttings, drilling mud, and/or other waste via injection under high pressure into an earth formation. Generally, the injection process involves the preparation of a slurry within surface-based equipment and pumping the slurry into a well that extends relatively deep underground into a receiving stratum or adequate formation. The basic steps in the process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

In some instances, the cuttings, which are still contaminated with some oil, are transported from a drilling rig to an offshore rig or ashore in the form of a thick heavy paste or slurry for injection into an earth formation. Typically the material is put into special skips of about 10 ton capacity that are loaded by crane from the rig onto supply boats. This is a difficult and dangerous operation that may be laborious and expensive.

U.S. Pat. No. 6,709,216 and related patent family members disclose that cuttings may also be conveyed to and stored in an enclosed, transportable vessel, where the vessel may then be transported to a destination, and the drill cuttings may be withdrawn. The transportable storage vessel has a lower conical section structured to achieve mass flow of the mixture in the vessel, and withdrawal of the cuttings includes applying a compressed gas to the cuttings in the vessel. The transportable vessels are designed to fit within a 20 foot ISO container frame. These conical vessels will be referred to herein as ISO vessels.

As described in U.S. Pat. No. 6,709,216 and family, the ISO vessels may be lifted onto a drilling rig by a rig crane and used to store cuttings. The vessels may then be used to transfer the cuttings onto a supply boat, and may also serve as buffer storage while a supply boat is not present. Alternatively, the storage vessels may be lifted off the rig by cranes and transported by a supply boat.

Space on offshore platforms is limited. In addition to the storage and transfer of cuttings, many additional operations take place on a drilling rig, including tank cleaning, slurrification operations, drilling, chemical treatment operations, raw material storage, mud preparation, mud recycle, mud separations, and others.

Due to the limited space, it is common to modularize these operations and to swap out modules when not needed or when space is needed for the equipment. For example, cuttings containers may be offloaded from the rig to make room for modularized equipment used for slurrification. These lifting operations, as mentioned above, are difficult, dangerous, and expensive. Additionally, many of these modularized operations include redundant equipment, such as pumps, valves, and tanks or storage vessels.

Slurrification systems that may be moved onto a rig are typically large modules that are fully self-contained, receiving cuttings from a drilling rig's fluid mud recovery system. For example, PCT Publication No. WO 99/04134 discloses a process module containing a first slurry tank, grinding pumps, a system shale shaker, a second slurry tank, and optionally a holding tank. The module may be lifted by a crane on to an offshore drilling platform.

Slurrification systems may also be disposed in portable units that may be transported from one work site to another. As disclosed in U.S. Pat. No. 5,303,786, a slurrification system may be mounted on a semi-trailer that may be towed between work sites. The system includes, inter alia, multiple tanks, pumps, mills, grinders, agitators, hoppers, and conveyors. As discussed in U.S. Pat. No. 5,303,786, the slurrification system may be moved to a site where a large quantity of material to be treated is available, such as existing or abandoned reserve pits that hold large quantities of cuttings.

U.S. Pat. No. 6,745,856 discloses another transportable slurrification system that is disposed on a transport vehicle. The transport vehicle (i.e., a vessel or boat) is stationed proximate the work site (i.e., offshore platform) and connected to equipment located at the work site while in operation. Deleterious material is transferred from the work site to the transport vehicle, wherein the deleterious material is slurrified. The slurry may be transferred back to the work site for, in one example, re-injection into the formation. Alternatively, the slurry may be transported via the transport vehicle to a disposal site. As disclosed in U.S. Pat. No. 6,745,856, storage vessels are disposed on the transport vehicle for containing the slurry during transportation. While in-transit to the disposal site, agitators disposed in the storage vessels may agitate the slurry to keep the solids suspended in the fluid.

While these systems and methods provide improved processes in slurrification and re-injection systems, they require difficult, dangerous, and expensive lifting and installation operations, as described above. Additionally, these processes may require lengthy installation and processing times that may reduce the overall efficiency of the work site.

During cuttings re-injection operations, a slurry is prepared including a fluid and cleaned drill cuttings. Typically, the slurry is prepared by mixing together drill cuttings previously classified by size at a desired ratio with a fluid, such that a slurry is created that contains a desirable percentage of drill cuttings to total volume. Those of ordinary skill in the art will appreciate that generally, the solids content of slurries used in cuttings re-injection operations is about 20 percent solids content by volume. Thus, in a given cuttings re-injection operation, a slurry is prepared for re-injection by mixing drill cuttings with a fluid until the solids content of the slurry is 20 percent. After preparation of the slurry, the slurry is pumped to a vessel for storage, until a high-pressure injection pump is actuated, and the slurry is pumped from the storage vessel into the wellbore.

In operations attempting to increase the solids content of the slurry to greater than 20 percent, thereby allowing for the re-injection of more cuttings into a formation, such operations have resulted in inconsistent, and thus, ineffective slurries. Typically, when a drilling operator has attempted to increase the solids content of the slurry, the slurry with a solids content of greater than 20 percent is created by mixing drill cuttings with a fluid, and then storing the mixture as described above. Because slurries are typically made in batches, stored, and then injected into the wellbore, during the storage of the slurry, prior to re-injection, the solids in the slurry would fall out of the suspension. As the solids fall out of the suspension, they may block or otherwise clog injection equipment, including flow lines and pumps, thereby preventing the slurry from being re-injection.

Furthermore, even if the slurry of greater than 20 percent solids content was injected into the wellbore, because the slurry is typically injected in batches, significant time may exist between injection operations. Thus, a slurry with a greater than 20 percent solids content may be injected downhole and the solids may begin to fall out of the suspension downhole during re-injection downtime. If the solids fall out of the suspension in the wellbore, prior to reaching the targeted formation, the solids may solidify in the wellbore, thereby blocking the wellbore for subsequent re-injection. Wellbores blocked in this way must then either be re-drilled, the cuttings removed using costly operations, or abandoned. Because of the high costs associated with removing cuttings from a blocked wellbore, wells blocked during re-injection are often abandoned, thereby causing a drilling operator to process residual slurry and cuttings using alternate methods.

Examples of alternate methods may include disposal of the cuttings in on-land cuttings pits or transferring the cuttings to alternate re-injection sites. In either situation, the drilling operation may incur additional expenses associated with the transport of the cuttings and slurry to alternate disposal sites, thereby increasing the overall cost of the drilling operation.

Thus, there exists a continuing need for slurrification systems that may increase the solids content of a re-injection slurry and provide a modular solution for cuttings re-injection operations.

SUMMARY OF DISCLOSURE

In one aspect, embodiments disclosed herein relate to a module for slurrifying drill cuttings that includes a skid, a programmable logic controller disposed on the skid, and a blender. The blender including a feeder for injecting drill cuttings, a gate disposed in fluid communication with the feeder for controlling a flow of the drill cuttings, and an impeller for energizing a fluid, wherein the module is configured to be removably connected to a cuttings storage vessel located at a work site.

In another aspect, embodiments disclosed herein relate to a method of creating a slurry that includes providing drill cuttings to a blender, the blender including a feeder for injecting the drill cuttings, a gate disposed in fluid communication with the feeder for controlling a flow of the drill fluids, and an impeller disposed in the blender for energizing the fluid. The method further includes providing a fluid to the blender, energizing the fluid in the blender, and injecting drill cuttings from the feeder into the energized fluid. Furthermore, the method includes mixing the drill cuttings and the energized fluid in the blender to create a slurry, wherein the slurry has greater than 20 percent by volume drill cuttings.

In another aspect, embodiments disclosed herein relate to a method of drill cuttings re-injection that includes creating a slurry including greater than 20 percent by volume drill cuttings in a blender system and pumping the slurry from the blending system to a cuttings injection system. The method further includes injecting the slurry from the cuttings injection system into a wellbore.

In another aspect, embodiments disclosed herein relate to a slurrification system that includes a cuttings storage vessel and a module fluidly connected to the cuttings storage vessel. The module includes a skid and a blender having a feeder for injecting drill cuttings, a gate disposed in fluid communication with the feeder for controlling a flow of the drill cuttings, and an impeller disposed in the blender for energizing a fluid, wherein the module is fluidly connected to a primary slurrification system.

Other aspects and advantages of the disclosure will be apparent from the following description and the appended claims.

DETAILED DESCRIPTION

In one aspect, embodiments disclosed herein relate to systems and methods for the slurrification of drill cuttings at a drilling location. The drilling location may include both onshore and off-shore drill sites. Additionally, embodiments disclosed herein relate to systems and methods for the slurrification of drill cuttings using a module-based slurrification system. More specifically, such embodiments relate to methods of using a slurrification system to increase the density of drill cuttings in a slurry.

Figure 1:
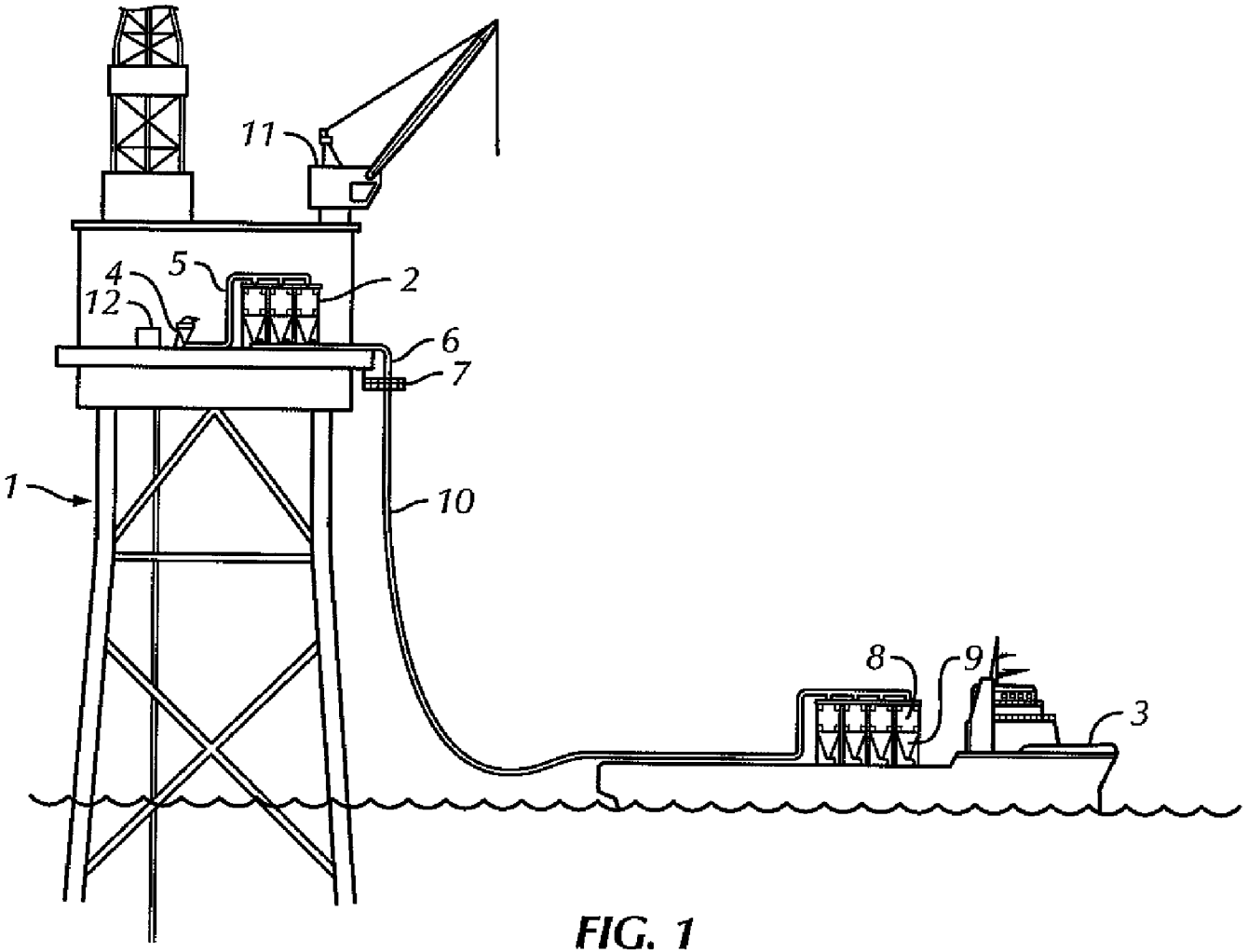
FIG. 1 shows a method of offloading drill cuttings from an offshore rig according to one embodiment of the present disclosure.

Referring initially to FIG. 1, a method of transporting drill cuttings between drilling rig according to one embodiment of the present disclosure is shown. In this embodiment, an offshore rig 1 may have one or more cuttings storage vessels 2 located on its platform. Cuttings storage vessels 2 may include raw material storage tanks, waste storage tanks, or any other vessels commonly used in association with drilling processes. Specifically, cuttings storage vessels 2 may include, for example, cuttings boxes and/or ISO-tanks (i.e., International Organization for Standardization tanks). In some embodiments, cuttings storage vessels 2 may include several individual vessels fluidly connected to allow the transference of cuttings therebetween. Such cuttings storage vessels 2 may be located within a support framework, such as an ISO container frame. As such, those of ordinary skill in the art will appreciate that cuttings storage vessels 2 may be used for both drill cuttings storage and transport.

As described above with respect to prior art methods, when cuttings storage vessels 2 are no longer needed during a drilling operation, or are temporarily not required for operations taking place at the drilling location, cuttings storage vessels 2 may be offloaded to a supply boat 3. Other systems and vessels for performing different operations may then be lifted onto the rig via crane 11, and placed where cuttings storage vessels 2 were previously located. In this manner, valuable rig space may be saved; however, conserving space in this manner may require multiple dangerous and costly crane lifts.

In contrast to the prior art methods described above, embodiments disclosed herein integrate cuttings storage vessels 2 into two or more operations that are performed on drilling rig 1. In one aspect, embodiments disclosed herein relate to integrating cuttings storage vessel 2 to operate in at least two operations on rig 1. In some aspects, embodiments disclosed herein relate to integrating cuttings storage vessel 2 to be used for both cuttings storage/transfer, as well as a second operation. More specifically, embodiments disclosed herein relate to using cuttings storage vessel 2 as both a storage/transfer vessel, as well as a component in a slurrification system. Although described with respect to integrating cuttings storage vessel 2 into slurrification system, those skilled in the art will appreciate that any vessel located at a drill site for performing a specified drilling operation may be integrated into the systems and methods for slurrification of cuttings disclosed herein.

Still referring to FIG. 1, offshore rig 1 may include one or more cuttings storage vessels 2 located on its platform. Drill cuttings generated during the drilling process may be transferred to cutting storage vessels 2 for storage and/or subsequent transfer in a number of different ways. One such method of transferring drill cuttings is via a pneumatic transfer system including a cuttings blower 4 and pneumatic transfer lines 5. Examples of systems using forced flow pneumatic transfer are disclosed in U.S. Pat. Nos. 6,698,989, 6,702,539, and 6,709,216, hereby incorporated by reference herein. However, those of ordinary skill in the art will appreciate that other methods for transferring cuttings from a cleaning operation (e.g., using vibratory separators) to cuttings storage vessels 2 may include augers, conveyors, and pneumatic suction systems.

In a system using pneumatic cuttings transfer, when cuttings need to be offloaded from a rig 1 to supply boat 3, cuttings may be discharged through pipe 6 to a hose connection pipe 7. Supply boat 3 is fitted with a supply assembly 8, wherein supply assembly 8 may include a number of additional cuttings storage vessels 9, including, for example, ISO-tanks. Supply boat 3 may be brought proximate to rig 1, and a flexible hose 10 extended therebetween. In this embodiment, flexible hose 10 fluidly connects storage assembly 8 to cuttings storage vessels 2 via connection pipe 7.

Embodiments of a slurrification system in accordance with the present disclosure, described below, may be combined in total, or as a modular unit with the cuttings transfer system described above. Furthermore, embodiments described below may incorporate components, such as, for example, the cuttings storage vessels described above, as part of the slurrification systems. Thus, in certain aspects of the present disclosure, slurrification systems for the production of high-solids content slurries for re-injection may include module based systems incorporating the existing infrastructure of a work site. As used herein, a high-solids content slurry is a slurry that includes 20 percent or greater solids content by volume.

Figure 2:
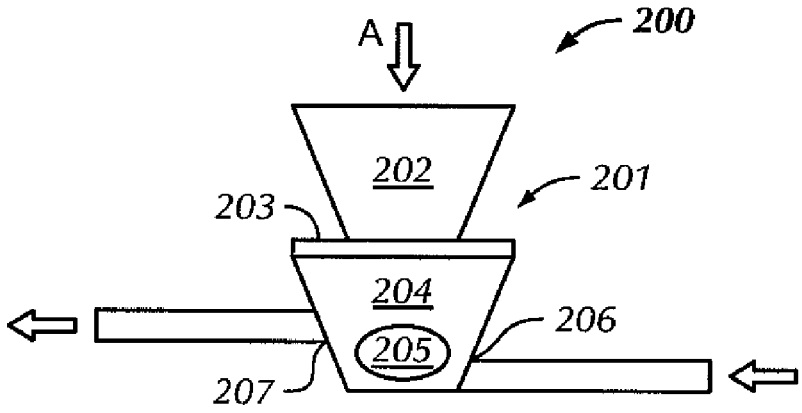
FIG. 2 shows a schematic view of a system for the slurrification of drill cuttings according to one embodiment of the present disclosure.

Referring to FIG. 2, a system 200 for increasing the solids content of a re-injection slurry in accordance with one embodiment of the present disclosure is shown. In this embodiment, system 200 includes a blender 201 having a feeder 202, a gate 203, and a mixing portion 204. Mixing portion 204 includes an impeller 205 to facilitate the slurrification of a solid with a liquid. Blender 201 also includes an inlet 206 configured to receive a liquid flow from upstream processing equipment and an outlet 207 configured to fluidly connect blender 201 to downstream processing equipment.

In one aspect, a dry material including, for example, dry drilling cuttings, is injected into feeder 202 (illustrated at arrow A). The dry material may be injected from upstream processing equipment including shakers, storage vessels, or other injection systems, and may be injected into feeder 202 through a conveyance device, such as, for example, screw augers or pneumatic transfer systems. In an embodiment wherein the dry material is drill cuttings, the cuttings may be blended (e.g., mixed) in feeder 202 with chemicals used in the slurrification process. In one aspect, such chemicals may include, powders, resins, and dry polymers as are known in the art.

Initially, when dry material is injected into blender 201, gate 203, disposed between feeder 202 and mixing portion 204, may be closed. Gate 203 may be configured to open and close according to a drilling operators instructions, such that a flow of dry material from feeder 202 to mixing portion 204 is controllable. The control of the flow of dry materials into mixing portion 204 may thereby allow control of a solids content of a slurry produced in system 200.

Mixing portion 204 is operatively connected to gate 203, such that gate 203 may be adjusted to control the flow of dry material therethrough. Mixing portion 204 includes an impeller 205 disposed such that a fluid that enters mixing portion 204 may be energized. The fluid is energized as it enters mixing portion 204 through inlet 206 due to the shearing action of impeller 205 as impeller 205 is accelerated in the fluid. Examples of impellers 205 may include, centrifugal pumps, blowers, turbines, fluid couplings, or any device used to force a fluid in a desired direction under pressure. In certain aspects, impeller 205 may further include roots or rotor blades for transmitting a specific direction or shearing action to the fluid. The speed of impeller 205 needed to effectively energize the fluid will vary according to the type of fluid being energized. Those of ordinary skill in the art will appreciate that in one aspect, the appropriate speed of impeller 205 may be any speed that does not cause separation of solids suspended within the fluid.

The fluid energized by impeller 205 is then directed into mixing portion 204, wherein gate 203 is opened, and dry material is injected thereto. The injection of the dry material may be controlled, such that the dry material mixes with the fluid at a desired rate, or such that a slurry of a desired solids content is produced. When the slurry reaches a desired condition, outlet 207 may be actuated to allow flow of the produced slurry from mixing portion 204 to downstream processing equipment.

In an embodiment wherein the dry material includes drill cuttings, the drill cuttings may be injected from upstream separation equipment (e.g., vibratory shakers), and injected directly into feeder 202. The fluid that enters mixing portion through inlet 206 may include a previously prepared slurry, such as a slurry that contains less than 20 percent solids. Thus, in such an embodiment, dry cuttings may be blended in blender 201 with a slurry of low solids content so as to fortify, or otherwise increase the solids content of a slurry prior to injection into a wellbore. In one aspect, the slurry that is injected into mixing portion 204 may have been previously produced as part of an existing cuttings re-injection system, such as those discussed above. The slurry with less than 20 percent solids content may also have been stored in a slurry storage vessel (not illustrated) after being produced in a batch cycle of slurrification. Thus, in one embodiment, system 200 may be used to increase the solids content of a slurry used for re-injection. However, those of ordinary skill in the art will appreciate that in certain embodiments, the only slurrification system at a drill site may be system 200. In such an embodiment, the fluid injected into mixing portion 204 may include, for example, water, sea water, brine solution, or liquid polymers, as would typically be used in preparation of a slurry for re-injection. Addition of the cuttings into mixing portion 204 may thus be controlled so as to produce a slurry having greater than 20 percent by volume solids content. In such an embodiment, it may be necessary to have several blenders 201 operating either in series, or in parallel, such that a rate of slurry production is appropriate for a given drilling operation.

In one embodiment, blender 201 may be a vortex mixer. In such an embodiment, impeller 205 may pull fluid through inlet 206, energize and blend the fluid with a quantity of cuttings controlled by gate 203. A solids accelerator (not shown) may add the cuttings to the energized fluid, and then the mixer may direct the produced slurry though outlet 207. The acceleratory motion applied to cuttings and the energization of the fluid provided by a vortex mixer, may thus allow a slurry of greater than 20 percent by volume to be produced. One example of a vortex blender than may be used with embodiments disclosed herein is the SBS-614 POD Blender, commercially available from Schlumberger. However, other blending devices operable as disclosed above may also be used with embodiments of the present methods and systems.

The operating parameters (e.g., time of operation, type of cuttings dosing, and injection rate) of slurrification system 200 may be controlled by an operatively connected programmable logic controller ("PLC") (not illustrated). The PLC contains instructions for controlling the operation of blender 204; such that a slurry of a specified solids content is produced. Additionally, in certain aspects, the PLC may contain independent instructions for controlling the operation of inlet 206, outlet 207, feeder 202, or gate 203. Examples of instructions may include time dependent instructions that control the time the slurry remains in mixing portion 204 prior to transference through outlet 207. In other aspects, the PLC may control the rate of dry material injection into mixing portion 204, or the rate of fluid transmittance through inlet 206. In still other embodiments, the PLC may control the addition of chemical and/or polymer additives, as they are optionally injected into mixing portion 204, feeder 202, or prior to energization of the fluid. Those of ordinary skill in the art will appreciate that the PLC may be used to automate the addition of dry materials, fluids, and/or chemicals, and may fiber be used to monitor and/or control operation of system 200 or blender 201. Moreover, the PLC may be used alone or in conjunction with a supervisory control and data acquisition system (not independently illustrated) to further control the operations of system 200. In one embodiment, the PLC may be operatively connected to a rig management system, and may thus be controlled by a drilling operator either at another location of the work site, or at a location remote from the work site, such as a drilling operations headquarters.

The PLC may also include instructions for controlling the mixing of the fluid and the cuttings according to a specified mixing profile. Examples of mixing profiles may include step-based mixing and/or ramped mixing. Step-based mixing may include controlling the mixing of cuttings with the fluid such that a predetermined quantity of cuttings are injected to a known volume of fluid, mixed, then transferred out of the system. Ramped mixing my include providing a steam of cuttings to a fluid until a determined concentration of cuttings in reached. Subsequently, the fluid containing the specified concentration of cuttings may be transferred out of the system.

In addition to, operatively connected to, or as a function of the PLC, blender 401 may include a distributed control unit ("DCU"). The DCU controls the density and additive rates, such that a slurry of a specified solids content may be produced. In certain aspects the PLC and/or DCU may thus control engine speeds, water temperature, oil pressure, fluid density, blender suction, discharge pressure, the injection rate of dry additives, injection rate of fluid additives, and the injection rate of primary slurries. To allow such control, measurements of the slurry in mixing portion 204, or measurements of other aspects of blender 201 may be required. Such measurements may be obtained through, for example, flow meters to determine blender suction, densitometers to determine the density of a fluid or slurry, and encoders to measure the addition rate of a dry material in the feeder 202 or a fluid flow rate through inlet 206. Additionally, PLC and/or DCU may control a power source or electrical connections required to operate components of system 200.

Figure 3:
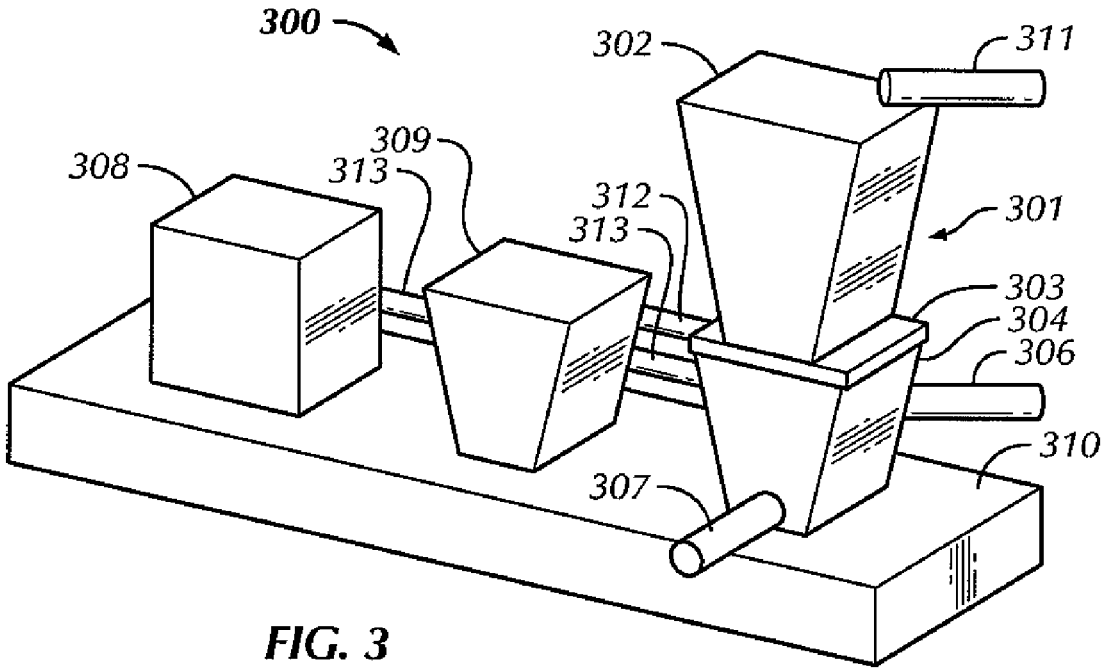
FIG. 3 shows a skid based system for the slurrification of drill cuttings according to one embodiment of the present disclosure.

Referring to FIG. 3, a module 300 for slurrifying drill cuttings, according to one embodiment of the present disclosure is shown. In this embodiment, module 300 includes a blender 301, a PLC 308, a chemical storage tank 309, and a skid 310. As illustrated, blender 301, PLC 308, and chemical storage tank 309 are disposed on skid 310. As described above, blender 301 includes a feeder 302, a gate 303, and a mixing portion 304. Solids may be fed into blender 301 via a transport line 311, and fluids may be communicated to blender 301 through an inlet 306. After preparation of a slurry, the slurry may exit blender 301 via outlet 307.

In this embodiment, dry cuttings are fed from transport line 311 into feeder 302, and a fluid is injected into mixing portion 304 through inlet 306. An impeller (not shown), disposed in mixing portion 304, energizes the fluid according to instructions provided by PLC 308 electrically connected to blender 301 via a control line 313. The instructions from PLC 308 may include time interval control instructions, as described above, or may otherwise regulate the mixing of a slurry by blender 302. As the fluid is energized in mixing portion 304 according to the appropriate instructions, dry cuttings are added by opening gate 303 to allow the flow of cuttings from feeder 302 into the energized fluid contained within mixing portion 304. During this blending, PLC 308 may further provide instructions to blender 301, chemical storage tank 309, or a pump (not shown) optionally disposed therebetween, to control a flow of slurrification chemicals into mixing portion 304. Those of ordinary skill in the art will appreciate that slurrification chemicals may alternatively be added to the fluid prior to injection into mixing portion 304, or to feeder 302 prior to injection of cuttings into mixing portion 304. As illustrated, the addition of chemical additives may occur via a chemical line 312 fluidly connecting chemical storage tank 309 with mixing portion 304.

In one embodiment, system 300 may be substantially self-contained on skid 310. Skid 310 may be as simple as a metal fixture on which components of system 300 are securably attached, or in other embodiments, may include a housing, substantially enclosing system 300. Because system 300 is disposed on skid 310, when a drilling operation requires a system that may benefit from increased solids content in a re-injection slurry, system 300 may be easily transported to the work site (e.g., a land-based rig, an off-shore rig, or a re-injection site). Those of ordinary skill in the art will appreciate that while system 300 is illustrated disposed on a rig, in certain embodiments, system 300 may include disparate components individually provided to a work site. Thus, non-modular systems, for example those systems not including a skid, are still within the scope of the present disclosure.

Figure 4:
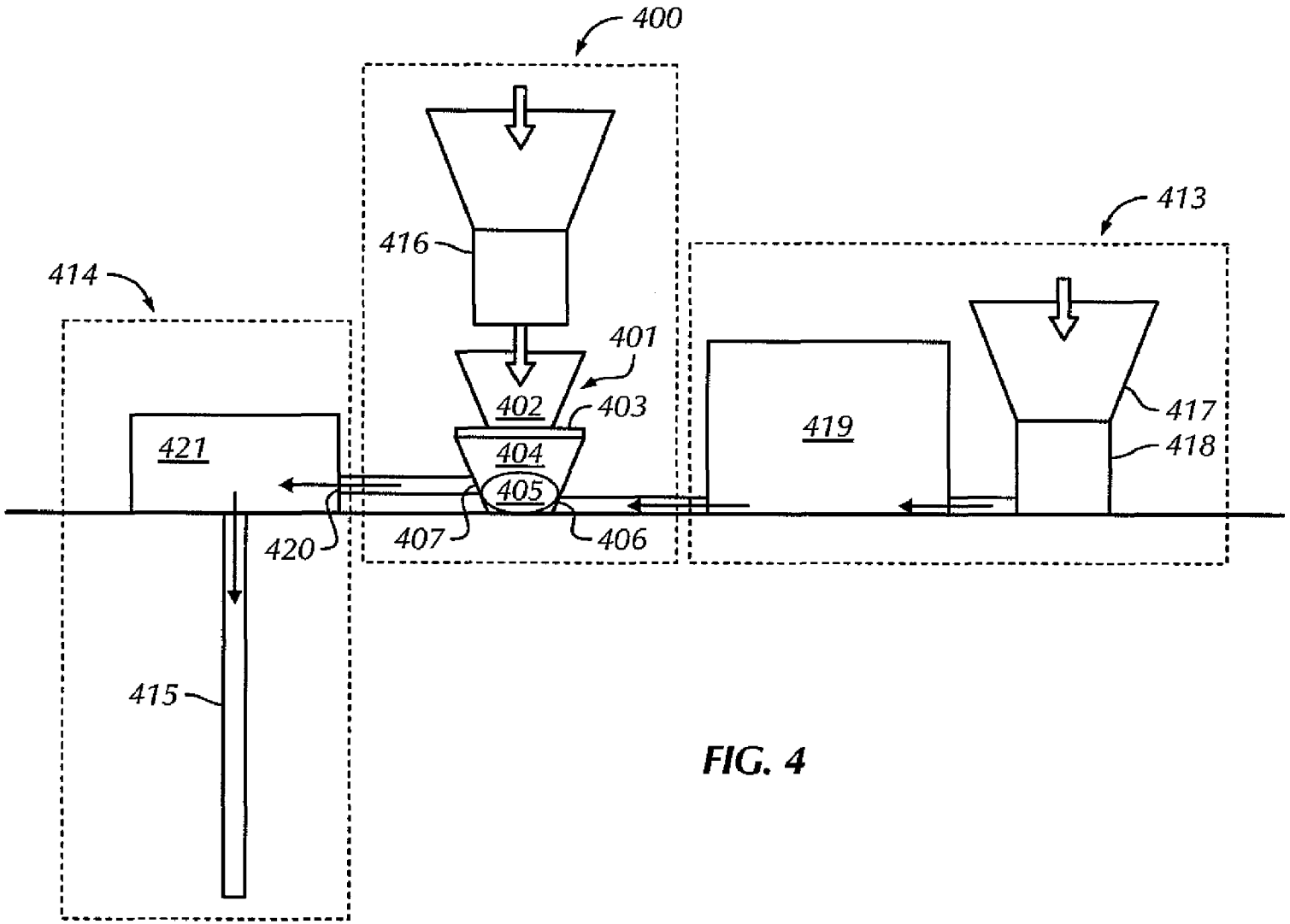
FIG. 4 shows a system for the slurrification of drill cuttings according to one embodiment of the present disclosure.

Referring now to FIG. 4, a cuttings slurrification and re-injection system, according to one embodiment of the present disclosure is shown. In this embodiment, a slurrification system 400 is fluidly connected to a primary slurrification system 413 and a re-injection system 414. Operatively, primary slurrification system 413 produces a slurry containing less than 20 percent by volume solids, slurrification system 400 increases the solids content of the slurry to over 20 percent by volume, and re-injection system 414 injects the slurry of greater than 20 percent by volume solids into a wellbore 415.

As previously described, slurrification system 400 includes a blender 401 having a feeder 402, a gate 403, and a mixing portion 404. Mixing portion 404 includes an impeller 405 to facilitate the slurrification of a solid with a liquid. Blender 401 also includes an inlet 406 configured to receive a liquid flow from primary slurrification system 413 and an outlet 407 configured to fluidly connect blender 401 to re-injection system 414. In this embodiment, dry cuttings are transferred from a cuttings storage vessel 416 via, for example, screw augers or pneumatic transfer devices. Examples of cuttings storage vessels may include cuttings boxes, ISO-tanks, or other vessels for holding cuttings as are known in the art. Other structural components may be included in slurrification system 400, including, for example, mills to reduce the size of the cuttings, and mechanical agitation devices to mix and/or prevent coagulation of the dry solids.

In one embodiment, primary slurrification system 413 includes cuttings storage vessel 417, a primary slurrification mixer 418, and a primary slurry storage vessel 419. In operation, cuttings from cuttings storage vessel 417 are injected into a mixer 418, and a slurry is produced that contains less than 20 percent by volume solids content. The slurry is stored in primary slurry storage vessel 419, where it remains until it is required for further slurrification and/or solids fortification in slurrification system 400. Those of ordinary skill in the art will appreciate that in certain embodiments, cuttings storage vessel 417 may be the same as cuttings storage vessel 416. And in certain embodiments, cuttings storage vessels 416 and 417 may include multiple vessels or vessel systems wherein cuttings may have been previously separated according to size. Thus, in one embodiment, the injection of cuttings from either cuttings storage vessels 416 or 417 may include injection of cuttings based on size (e.g., fines or course cuttings), and at a specific rate to produce a slurry of a specified solids content.

Cuttings re-injection system 414 includes an inlet 420 fluidly connected to slurrification system 400 and an injection pump 421 disposed proximate wellbore 415. Those of ordinary skill in the art will appreciate that pump 421 may include either high-pressure pumps, low-pressure pumps, or other pumping devices known to those of ordinary skill in the art capable of forcing or otherwise facilitating the conveyance of a fluid into a wellbore. Furthermore, in certain embodiments, the high solids content of the slurry produced by system 400 may require additional pressure (i.e., a high-pressure pump) to facilitate the pumping of the slurry downhole. However, in certain embodiments, because the injection of the slurry downhole may be substantially continuous, a low-pressure pump may be adequate to facilitate the injection.

In operation, cuttings are injected into a cuttings storage vessel 417 from an upstream processing operation (e.g., a vibratory separator). The cuttings are mixed with fluids in mixer 418 to produce a primary slurry, the primary slurry including less than 20 percent by volume solids content. Those of ordinary skill in the art appreciate that while the majority of the solids content may include drill cuttings supplied from cuttings storage vessel 417, in certain aspects, the solids content may also include weighting agents and/or chemical additives, either not removed during the upstream processing operations, or added for the benefit of the slurry.

After the primary slurry is produced in mixer 418, the primary slurry is transferred to primary slurry storage tank 419. The slurry may be produced in a batch cycle, such that a large amount of slurry may be produced and then stored. Generally, as described above, slurries including less than 20 percent by volume solids may be stored for periods of time without the solids separating from the liquid phase of the slurry. However, in certain embodiments, it may still be beneficial to include agitators (e.g., mechanical stirring devices) in primary slurry storage tank 419 to ensure the primary slurry does not separate into its component parts. In certain aspects, the primary slurry may be made substantially continuously, not in a batch cycle, and in such operations, the need for agitation devices may not be required.

When a drilling operator decides to initialize a cuttings re-injection cycle, primary slurry is injected into mixing portion 404 of blender 401 via inlet 406. Impeller 405 energizes the primary slurry, and gate 403 is opened to allow the addition of cuttings from feeder 402. The mixing of the slurry in mixing portion 404 may be controlled via a PLC, as described above, and may include the addition of chemical additives, water, sea water, brine solution, polymers, fines, course grinds, dry cuttings, and/or slurry from multiple sources. Thus, in one embodiment, a multiple blender system may allow a secondary blender to process a fluid including a slurry with a solids content greater than 20 percent by volume.

The slurry of greater than 20 percent by volume solids content is then transferred out of mixing portion 404 via outlet 407. Outlet 407 of slurrification system 400 is fluidly connected to cuttings re-injection system 414. In this embodiment, the re-injection system may include high-pressure injection pump 421 disposed proximate wellbore 415. As the high-solids content slurry is produced by slurrification system 400, injection pump 421 is actuated to pump the slurry into wellbore 415. Those of ordinary skill in the art will appreciate that because the production of the high-solids content slurry may be slower than preparation of the primary slurry, the injection process may be substantially continuous. Thus, once a cuttings re-injection cycle is initiated, it may remain in substantially continuous operation until a drilling operator terminates the operation.

Additionally, the use of blender 401 allows the solids content in the slurry to remain more evenly divided and suspended. As such, even if a re-injection process is stopped, the separation of solids from the suspension, as discussed above, may be avoided.

Figure 5:
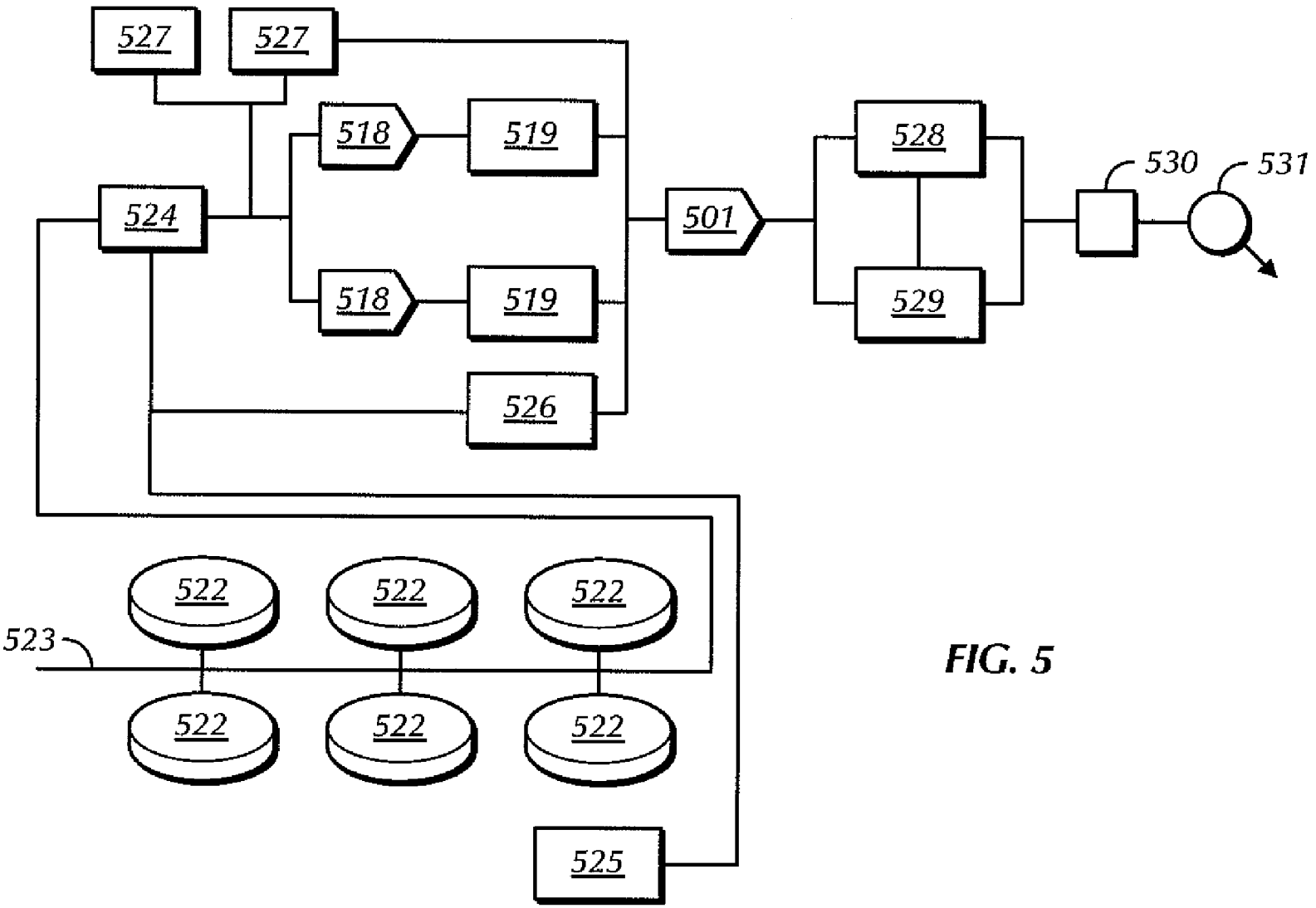
FIG. 5 shows a schematic view of a slurrification system according to one embodiment of the present disclosure.

Referring now to FIG. 5, a schematic representation of a slurrification and re-injection system 500 in accordance with embodiments disclosed herein is shown. In this embodiment, system 500 is illustrated as may be found on an off-shore rig. Initially, dry cuttings may be collected in cuttings storage vessels 522. Cuttings storage vessels 522 may be connected to additional upstream processing equipment via, for example, piping and/or pneumatic transfer lines 523. Cuttings storage vessels 522 are also fluidly connected to a hydration system 524, such that when a drilling operator initiates the batch processing of a re-injection slurry, the dry cuttings are hydrated prior to mixing. Hydration may include adding fluids to the cuttings. The fluids may include liquid polymers, water, seawater, brine solution, or other hydration media contained within a fluids reservoir 525. Those of ordinary skill in the art will appreciate that in alternate embodiments, fluids may be supplied directly from the surrounding environment by, for example, a bilge pump. Thus, in certain embodiments, fluids reservoir 525 may be unnecessary. However, as illustrated, fluids reservoir 525 is fluidly connected to both hydration system 524 and a component mixer 526. Component mixer 526 may be used to mix fluids, liquid chemicals, dry chemicals, or other additives for use in slurrification processes prior to injection into a blender 501.

As fluids from fluids reservoir 525 and cuttings from cuttings storage vessels 522 combined, they are injected into a primary slurrification mixer 518. As illustrated, the system includes two slurrification mixers 518, however, those of ordinary skill in the art will appreciate that the number of mixers 518 may vary according to anticipated and desired production and re-injection rates. Generally, the slurry produced by mixing the fluids and cuttings will be transferred to one or more primary slurry storage tanks 519. In certain embodiments, prior to slurrification in mixers 518, additional dry cuttings may be added from secondary storage vessels 527. The primary slurry produced in mixers 518, as described above, contains less than 20 percent by volume solids content. As such, the primary slurry may be stored in primary slurry storage tanks 519 prior to use in the secondary slurrification process.

While shown independent of cuttings storage vessels 522, those of ordinary skill in the art will appreciate that secondary storage vessels 527 may include dry cuttings, or in certain embodiments, may also be cuttings storage vessels 522. However, in one aspect, secondary storage vessels 527 may include dry or liquid polymers or chemicals used in the slurrification process, and as such, may be in fluid communication with mixers 518.

When a drilling operator elects to begin a cuttings re-injection cycle, the primary slurry is injected into blender 501, as described above, along with additional dry cuttings and/or chemicals from either secondary storage vessels 527 or component mixer 526. In alternate embodiments, the solids may be fed directly from cuttings storage vessels 522, as previously described. The solids and fluids are mixed to produce a slurry including greater than 20 percent by volume solids content. Thus, in one aspect of the present disclosure, the final slurry, prior to injection, may include greater than 20 percent solids, 40 percent solids, 50 percent solids, or even a greater solids content as determined by the requirements of a specific re-injection operation.

After production of the high-solids content slurry, the slurry is fluidly communicated to high-pressure pumps 528, low-pressure pumps, or both types of pumps to facilitate the transfer of the slurry into a wellbore. In one embodiment, the pumps may be in fluid communication with each other, so as to control the pressure at which the slurry is injected downhole. However, to further control the injection of the slurry, additional components, such as pressure relief valves 530 may be added in-line prior to the dispersal of the slurry in the wellbore. Such pressure relief valves may help control the pressure of the injection process to increase the safety of the operation and/or to control the speed of the injection to further increase the efficiency of the injection process. The slurry is then transferred to downhole tubing 531 for injection into the wellbore. Downhole tubing 531 may include flexible lines, existing piping, or other tubing know in the art for the re-injection of cuttings into a wellbore.

Advantageously, embodiments disclosed herein may provide for systems and methods that allow for the production and injection of high-solids content slurries for re-injection operations at drill sites. Such high-solids content slurries, containing a solids portion of greater than 20 percent by volume of the slurry may allow for re-injection operations to be completed more quickly and more efficiently than using low-solids content slurries. Increasing solids content in a slurry may also allow for the re-injection process to be substantially continuous, thereby preventing blocked wellbores, expensive re-drilling operations, or chemical treatments associated with existing re-injection operations. Furthermore, embodiments of the present disclosure may advantageously decrease the amount of lifting operations for cuttings injection equipment by making the slurrification system a module that uses existing rig and/or drill site infrastructure. Such operations may increase drilling efficiency, decrease rig downtime, decrease accidents at the work site, and otherwise decrease the costs associated with re-injection operations.

While the disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A module for slurrifying drill cuttings comprising:

a skid;

a programmable logic controller disposed on the skid; and a blender disposed on the skid, the blender comprising:

a feeder for injecting drill cuttings;

a gate disposed in fluid communication with the feeder for controlling a flow of the drill cuttings; and an impeller for energizing a fluid;

wherein the module is configured to be removably connected to a cuttings storage vessel located at a work site.

2. The module of claim 1, wherein the blender further comprises:

an outlet;

wherein the outlet is configured to fluidly communicate with a cuttings injection system.

3. The module of claim 2, wherein the programmable logic controller provides instructions for a substantially continuous injection of a slurry from the cuttings storage vessel to a wellbore.

4. The module of claim 1, wherein the programmable logic controller includes instructions for mixing a slurry from the fluid and the drill cuttings.

5. The module of claim 4, wherein the slurry comprises greater than 20 percent by volume drill cuttings.

6. The module of claim 1, wherein the fluid is a primary slurry.

7. The module of claim 1, further comprising:

at least one chemical storage tank in fluid communication with the blender.

8. A method of creating a slurry comprising:

providing drill cuttings to a blender, the blender comprising:

a feeder for injecting the drill cuttings;

a gate disposed in fluid communication with the feeder for controlling a flow of the drill fluids; and an impeller disposed in the blender for energizing the fluid;

providing a fluid to the blender;

energizing the fluid in the blender;

injecting drill cuttings from the feeder into the energized fluid; and mixing the drill cuttings and the energized fluid in the blender to create a slurry;

wherein the slurry comprises greater than 20 percent by volume drill cuttings.

9. The method of claim 8, wherein the injection of the drill cuttings is controlled by a programmable logic controller operatively connected to the blender.

10. The method of claim 9, wherein the programmable logic controller adjusts the flow of drill cuttings into the blender.

11. The method of claim 9, wherein the programmable logic controller adjusts the flow of the fluid into the blender.

12. The method of claim 9, wherein the programmable logic controller automatically adjusts the injection of the slurry into a wellbore according to a density measurement of the slurry.

13. The method of claim 8, wherein the slurry comprises greater than 40 percent by volume drill cuttings.

14. The method of claim 8, wherein the fluid comprises a primary slurry.

15. The method of claim 8, wherein the fluid comprises at least one of a group consisting of water, a polymer, and a brine solution.

16. A slurrification system comprising:

a cuttings storage vessel; and a module fluidly connected to the cuttings storage vessel, the module comprising:

a skid; and a blender, the blender comprising:

a feeder for injecting drill cuttings;

a gate disposed in fluid communication with the feeder for controlling a flow of the drill cuttings; and an impeller disposed in the blender for energizing a fluid;

wherein the module is fluidly connected to a primary slurrification system.

17. The system of claim 16, wherein the module further comprises:

a programmable logic controller operatively coupled to the blender.

18. The system of claim 16, wherein the module further comprises:

a fluid storage reservoir in fluid communication with the blender.

19. The system of claim 16, wherein the fluid comprises a primary slurry.

20. The system of claim 19, wherein the blender is configured to produce a slurry from the drill cuttings and the primary slurry that includes greater than 20 percent by volume drill cuttings.

* * * * *